United States Patent [19]

Reinwall, Jr.

[11] 4,034,532

[45] July 12, 1977

[54] ROOF HOLD DOWN CLIP ASSEMBLY

[75] Inventor: Ernest William Reinwall, Jr., McHenry, Ill.

[73] Assignee: Illinois Tool Works Inc., Chicago, Ill.

[21] Appl. No.: 685,839

[22] Filed: May 13, 1976

[51] Int. Cl.[2] ..... E04D 3/364

[52] U.S. Cl. ..... 52/520; 52/544; 52/573

[58] Field of Search ..... 52/544, 520, 573, 509, 52/588

[56] References Cited

U.S. PATENT DOCUMENTS

| | | | |
|---|---|---|---|
| 1,787,464 | 1/1931 | Anderson | 52/573 |
| 2,435,172 | 1/1948 | Young | 52/487 |
| 2,857,995 | 10/1968 | Boulton | 52/520 |
| 3,209,503 | 10/1965 | Mastoller | 52/520 |
| 3,309,829 | 3/1967 | Berridge | 52/521 |
| 3,388,518 | 6/1968 | Scott | 52/520 |
| 3,394,519 | 7/1968 | Tischuk | 52/520 |
| 3,408,786 | 11/1968 | Snyker | 52/544 |

FOREIGN PATENT DOCUMENTS

| | | | |
|---|---|---|---|
| 706,575 | 3/1965 | Canada | 52/544 |
| 1,206,435 | 9/1970 | United Kingdom | 52/544 |
| 105,447 | 4/1917 | United Kingdom | 52/544 |

*Primary Examiner*—Price C. Faw, Jr.
*Assistant Examiner*—Henry Raduazo
*Attorney, Agent, or Firm*—Thomas W. Buchman; Robert W. Beart

[57] ABSTRACT

A clip assembly for securing abutting edges of roof deck panels together and to an underlying support structure in such a manner as to conceal the clip assembly and permit relative longitudinal movement of the panels to the support structure responsive to forces from thermal expansion or contraction. The clip assembly comprises a clip member and a foot member slidably interconnected by a hook on the foot member which is received in an elongate slot formed in the clip member. The clip and the foot interconnection includes means to center the two members relative to one another.

9 Claims, 14 Drawing Figures

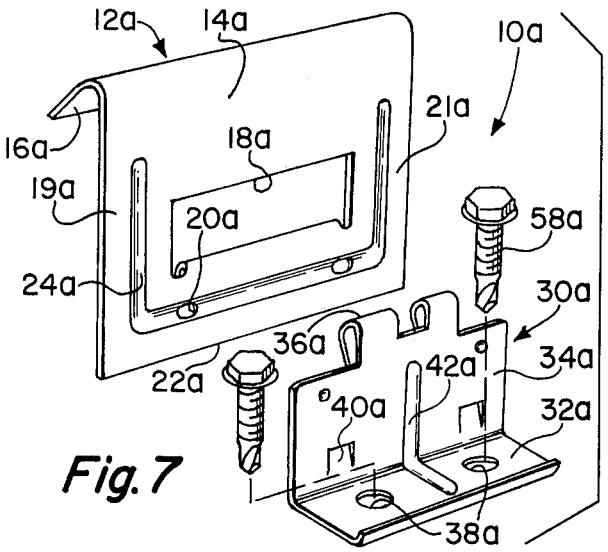
Fig. 7
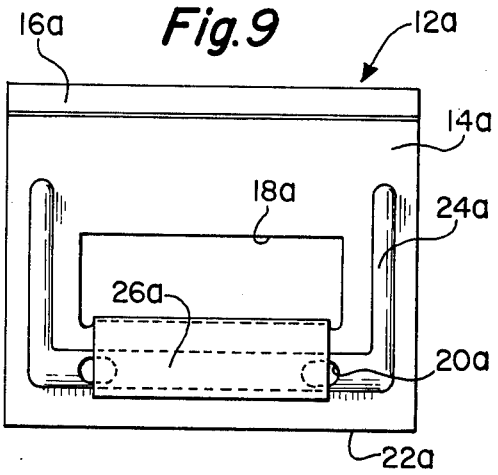
Fig. 9
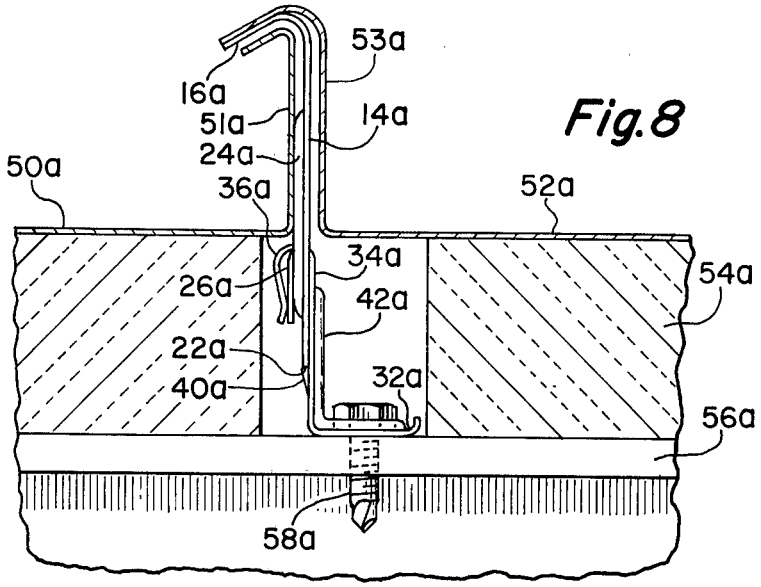
Fig. 8
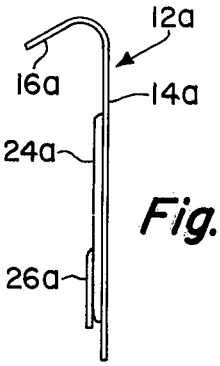
Fig. 10
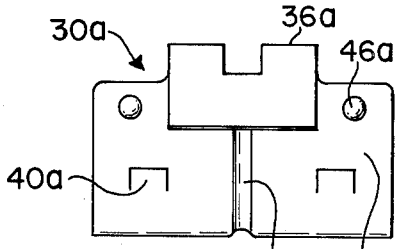
Fig. 11
Fig. 12
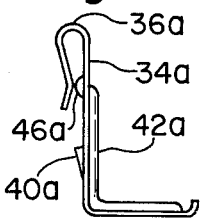
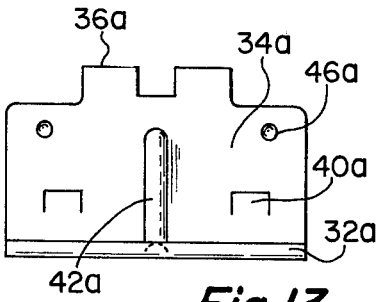
Fig. 13
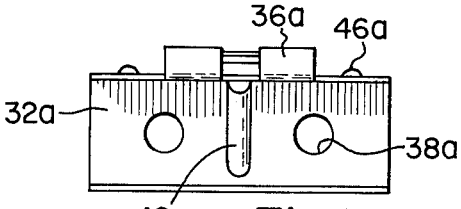
Fig. 14

ROOF HOLD DOWN CLIP ASSEMBLY

BACKGROUND OF THE INVENTION

The present invention relates generally to the interconnections of roof panels and the securement of the roof panels to a supporting structure.

More particularly, the invention relates to a clip assembly which will provide superior pull-up strength and permit the roof panels to contract or expand due to changes in temperature without damaging the interconnection joint in such a manner as to create leakage problems.

The corrugated type of roof construction considered to be secured by the clip assembly of this invention typically has previously been clamped to a purlin member by direct application of a threaded fastener through the valley of a corrugation and into the purlin. This produces an obvious problem in that the joint must now be secured from moisture by a sealing cap or through the use of a sealing washer. The joint also will not permit relative expansion and contraction of the panels without damaging the panel in the area of the joint.

Other prior art devices relative to a roof hold down fastener utilize a hold down clip device which is interleaved between abutting and crimped lips on adjacent roof panels. The clip is then secured directly to a purlin by rigidly clamping a base portion of the clip thereto and then crimping the abutting edges of the roof panels to an upstanding web formed integrally on the clip. This type of construction has likewise been deficient in its capability to harmlessly allow expansion and contraction of the roof panels.

Other problems that are inherent in the prior art methods and devices for securing roof panels to a supporting structure include their failure to prevent condensation from forming on the clip or the fastener. Even if the joint is properly sealed, the difference in temperature between the outer surface of the building and the inner surface of the building will create condensation and moisture on the clip and fastener located within the building.

SUMMARY OF THE INVENTION

The present invention is directed to solving the problems of the prior art enumerated above. The clip assembly in accordance with this invention will include two discrete members, i.e., a clip member, upon which abutting edges of roof deck panels are crimped and otherwise secured, and a foot member which is directly and fixedly secured to a purlin with a conventional fastener, preferably of a self-drilling variety. The clip and foot members are movably attached to one another through the use of a longitudinal slot of a given length in the clip and a hook portion of the foot which is received in the slot and is of a given width substantially less than the length of the slot. Detachable means for initially locating and retaining the two members in a centered position are provided on associated surfaces of the clip and foot members. The structure of these centering are designed to release upon a certain longitudinal force exerted on the clip member which may typically be that resulting from thermal expansion or contraction of the roof panels.

The clip assembly of the present invention is designed to reduce the possibility of condensation forming within a building as a result of a temperature differential inside and outside of the building. in one embodiment, the foot member is constructed of a thermoplastic material which serves as a thermal barrier between the outermost surfaces of the roof deck and the innermost surfaces of the clip assembly within the building. A significant reduction in the surface area of the clip member in the region of its association with the foot member also serves to reduce the amount of condensation that could be formed within the building.

The two piece clip assembly described herein is economically advantageous, in that a single foot member design can be used to accommodate a wide variety of clip members which may be required to associate with many different roof panel abutting edge configurations. In addition to this economic advantage, the foot member can be preassembled to a threaded fastener member as a washer might be associated thereto using conventional preassembly techniques.

It is therefore a principal object of the invention to provide a roof deck panel joint construction which permits longitudinal expansion and contraction of roof panels without damaging the joint.

It is a further object of the invention to provide a two piece clip assembly which is designed to secure abutting panel edges to a purlin in a concealed manner.

A further object of the invention is to provide a clip assembly which reduces the condensation forming beneath a panel joint construction which is a result of temperature differential inside and outside of the buildings.

Still a further object of the invention is to provide a roof deck clip assembly which is designed to afford maximum strength against uplift forces on the roof deck while utilizing a minimum amount of material in the clip.

These and other objects and advantages of the invention will become apparent upon reading the following detailed description and upon reference to the drawings included herewith.

BRIEF DESCRIPTION OF THE DRAWINGS

FIG. 7 is an exploded view of an alternate embodiment of the clip assembly of this invention.

FIG. 8 is a transverse cross-sectional view of a pair of interlocked roof panels joined to a purlin through the use of the alternate embodiment of the clip assembly.

FIG. 9 is a rear elevation view of the clip member of the alternate embodiment.

FIG. 10 is a side elevation view of the clip member of the alternate embodiment.

FIG. 11 is a rear elevation view of the foot member of the alternate embodiment.

FIG. 12 is a side elevation view of the foot member of the alternate embodiment.

FIG. 13 is a front elevation view of the foot member of the alternate embodiment.

FIG. 14 is a top plan view of the foot member of the alternate embodiment.

DETAILED DESCRIPTION OF THE PREFERRED EMBODIMENTS

Figure 1:
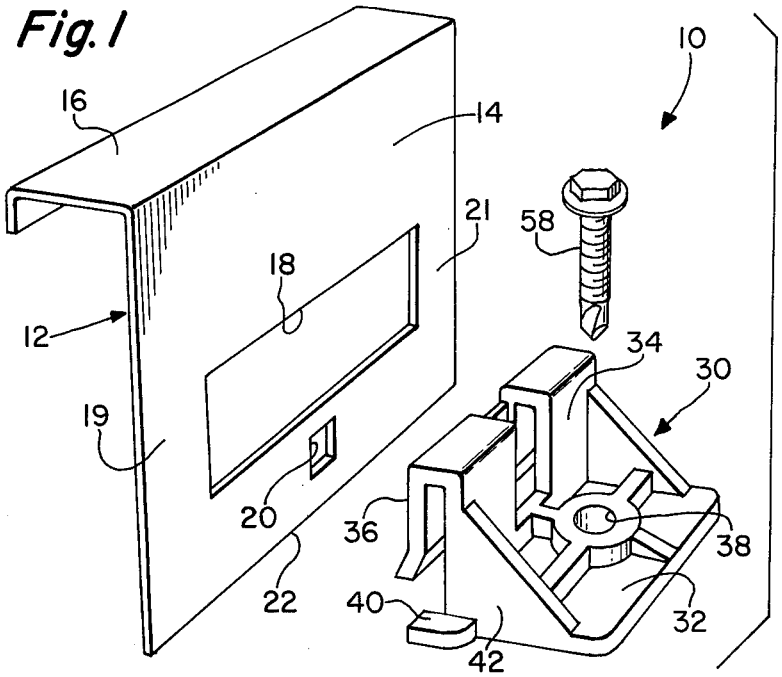
FIG. 1 is an exploded view of a preferred embodiment of the clip assembly.
Figure 2:
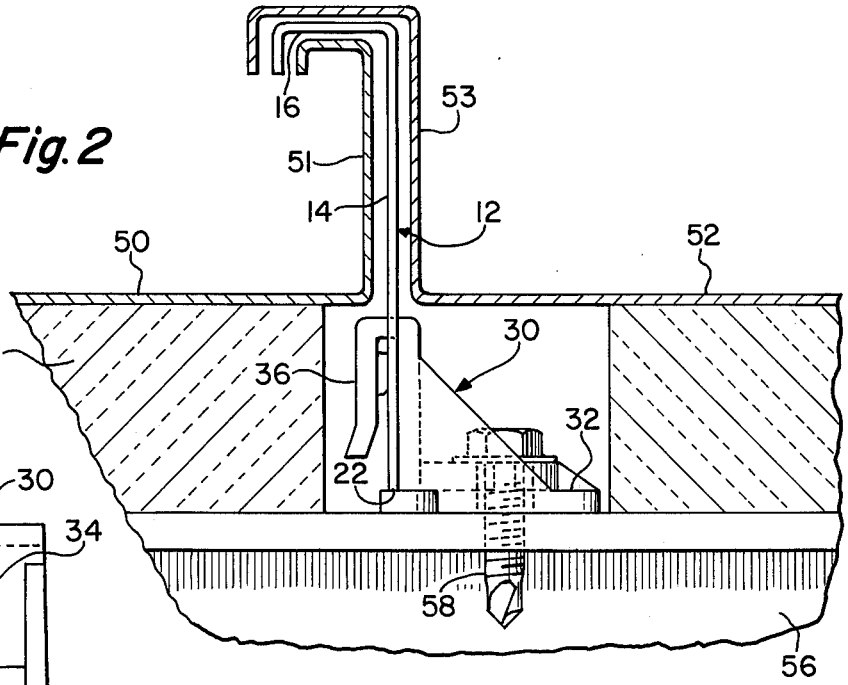
FIG. 2 is a transverse cross-sectional view of the clip assembly connecting a pair of interlocked roof panels to a purlin.
Figure 3:
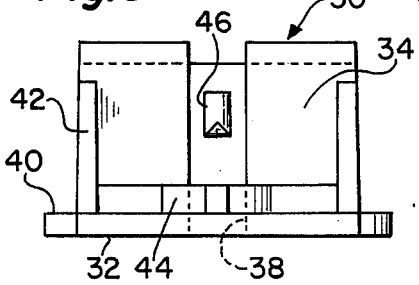
FIG. 3 is a front elevation view of the foot member of the assembly shown in FIG. 1.
Figure 4:
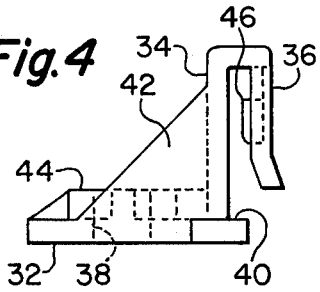
FIG. 4 is a side elevation view of the foot member shown in FIG. 1.
Figure 5:
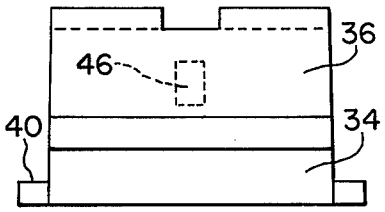
FIG. 5 is a rear elevation view of the foot member shown in FIG. 1.
Figure 6:
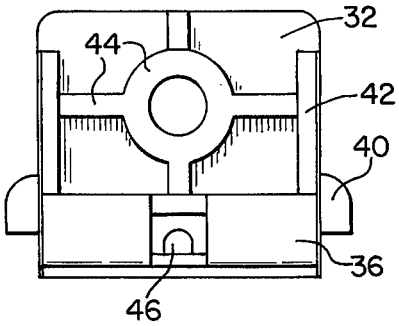
FIG. 6 is a top plan view of the foot member shown in FIG. 1.

Turning to FIGS. 1 and 2, the preferred embodiment of the clip assembly 10 is shown to include a clip member 12 and a foot member 30 which are slidably interconnected by an elongate slot 18, formed in the web 14 of the clip member, and downturned hook section 36, extending from an upper edge of a leg section 34 on the foot member.

The uppermost margin of the clip member 12 will include a flange 16 extending laterally in one direction from the web and configured to correspond with the lips on abutting edges of roof panels to be secured.

The elongated aperture or slot 18 formed in the web of the clip will be of a predetermined length and will form a pair of narrow surfaces 19 and 21 adjacent the side margins of the web providing an advantageous function to be described later herein. The hook portion 36 will be of a width less than the length of the slot 18 to permit relative movement therein.

One of the features of the invention is the strength provided to the joint structure resisting uplift forces which are commonly applied to roof construction of this type. The upstanding leg portion 34 and base surface 32 of the foot are interconnected by a rib structure 42 which strengthens the clip assembly while minimizing the thickness of the material.

The foot member 30 is preferably formed of a thermoplastic material. The presence of this thermoplastic foot member between the clip member and the purlin and/or fastener member 58 provides a thermal barrier which effectively prevents the formation of condensation beneath the roof which normally would occur responsive to a large temperature differential between the outer and inner surfaces of the roof deck. in addition to this insulating feature of the preferred embodiment, the narrow surfaces of web section 19 and 21 reduce the heat transfer surface area from the roof deck panels to the innermost temperature regions. Thus, a further reduction in the possibilities of condensation is inherently provided in the structure of this clip assembly.

It is highly advisable to secure the foot member 30 to the clip member 12 in a manner which will permit movement in either longitudinal direction. For this purpose, a releasable centering and locating structure is formed on mating surfaces of the clip and foot. An aperture 20 is formed through the web of the clip 12 cooperating with and receiving a protuberance 46 formed on the innermost surface of the hook 36. This protuberance 46 snaps in place within the aperture 20 but may be forced out of place as a result of thermal expansion forces applied in a longitudinal direction to the clip 12.

To facilitate assembly of the foot member to the purlin, the fastener 58 and foot member 30 may be preassembled in a manner which is known in the prior art. The foot member may be precisely and accurately located on the purlin through the use of the abutting edge 51 of a roof panel 50 which has previously been secured at its opposite lateral edge. When the foot member has been located, the fastener clamps against reinforcing bosses 44 and fixedly secures the foot to the purlin. The clip 12 is associated with the foot by placing the hook 36 of the foot in the elongated aperture 18 and snapping the protuberance 46 in the associated aperture 20. The clip will also be located and secured in a downward direction through the use of stop ledges 40 which are formed on the foot and which extend laterally outwardly of the leg 34 on the same side of the leg as the hook. The stop ledges 40 abut with the lowermost edge 22 of the clip to prevent further downward movement of the clip and the abutting edges of the roof panels. A typical roof construction will also include a layer of insulative material such as 54 shown in FIG. 2.

When the clip device 12 has been associated with the foot member, the edge 53 of next adjoining panel 52 is crimped to both the flange 16 of the clip and to the associated flange of abutting edge 51. Thus, adjoining panels are secured relative to each other and to the clip 14 but are free to move longitudinally relative to the purlin as a result of interrelation of slot 18 and hook 36.

FIGS. 7–14 illustrate an alternate embodiment of the invention and like reference numerals throughout the various views are intended to designate similar elements or components to that of the first described embodiment.

Clip assembly **10*a* will again include a clip member 12*a* and a foot member 30*a*. Both the foot member 30*a* and the clip member 12*a* will be constructed of a sheet metal material. A longitudinal slot or elongated aperture 18*a* is formed in the web 14*a* of the clip and is of a predetermined length which is greater than the width of the hook 36*a* formed in the foot member. The elongate aperture 18*a* will present narrow surfaces 19*a* and 21*a* to reduce the heat transfer in the clip and therefore reduce the condensation formed inside the building. This embodiment will also include rib structure 24*a* and 42*a*** on the clip and foot respectively, which maximizes the strength of the joint relative to both uplift forces and lateral forces while minimizing the thickness of the material utilized in the clip assembly.

Further reinforcement to the clip is obtained through the use of a downwardly extending flap **26*a* which is formed from the lowermost edge of the aperture and overlies the lower section of the web 14*a***.

Spring tabs **40*a* are punched from the leg 34*a* of this embodiment and serve to resiliently stop and abut against the bottommost edge 22*a* of the clip. This interaction prevents unrestrained downward movement of the clip to accurately locate the flange 16*a* relative to the height of the edges 51*a* and 53*a*** which are to be secured. It further restricts the downward movement of the abutted joint due to forces exerted on the joint in that area.

The foot member **40*a* is clamped to the purlin 56*a* with a pair of fastener members 58*a* extending through a pair of apertures 38*a* in the base 32*a*. As in the preferred embodiment, the foot member 40*a*** may be preassembled to the fastener.

A pair of dimples **46*a* formed outwardly of the leg mate with a pair of apertures 20*a* in the lowermost region of the web of the clip. These protuberances and holes releasably lock the member 12*a* to the member 30*a* but may be unlocked due to excessive longitudinal expansion forces exerted on the clip 12*a***.

It should be clear from the above description that a joint construction and clip assembly for use in joint constructions has been provided which secures, in a concealed fashion, adjoining roof deck panels and yet allows the roof deck panels to expand and contract due to thermal changes as well as minimizing the condensation effects of a thermal differential between the outer and inner surfaces of the structure. The clip assembly just described, being of a two piece construction, will provide a greater flexibility in designs of flanges to be used in crimping abutting edges of roof panels without changing the design of the foot member.

While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A roof hold down clip assembly including a clip member for engaging and retaining abutting edges of roof deck panels and an attachment foot member for securing the clip member to a support structure while allowing relative longitudinal movement between said members, the clip member including an upstanding web with a longitudinal upper edge defined by a flange extending laterally of the web in one direction, an elongate slot of a predetermined length formed in the web extending longitudinally between the margins thereof, the attachment foot member including a base with an upstanding leg section and a hook section with a predetermined width extending from the leg section, the width of the hook section being less than the predetermined length of the slot in the web, the foot member and clip member including cooperating means releasably retaining said members in a first longitudinal position relative to each other with said releasable means being in the form of a mating hole and protuberance means on the web of the clip and the foot member, allowing relative longitudinal movement between the two members when the base has been secured to the support structure and the flange cooperates with abutting edges of roof deck panels to secure said edges to the clip member.

2. The clip assembly of claim 1, wherein the base includes an aperture permitting the shank of a fastener to pass therethrough to clamp the foot member to a support structure.

3. The clip assembly of claim 1, wherein the foot member is formed of a thermoplastic material to serve as a thermal barrier between the clip member and a support structure.

4. The clip assembly of claim 1, wherein the foot member includes rib means on the base and leg portions interconnecting said portions and providing lateral strength to said member.

5. The clip assembly of claim 1, wherein the foot member includes stop means extending laterally from the leg in a direction opposing the base portion, the stop means limiting the downward travel of the clip member relative to the foot member.

6. The clip assembly of claim 5, wherein the stop means is in the form of a tab struck out from the leg.

7. The clip assembly of claim 5, wherein the foot member is formed of a thermoplastic material and the stop means is in the form of a pair of ledges extending laterally and longitudinally of the leg.

8. The clip assembly of claim 1, wherein the web includes reinforcing rib means formed thereon.

9. The clip assembly of claim 1, wherein a flap is integrally formed from the bottommost edge of the elongate slot and extends downwardly therefrom to strengthen the clip member.

* * * * *